US008424262B2

(12) United States Patent
Deblander et al.

(10) Patent No.: US 8,424,262 B2
(45) Date of Patent: Apr. 23, 2013

(54) POLYMERIC FIBER INSULATION BATTS FOR RESIDENTIAL AND COMMERCIAL CONSTRUCTION APPLICATIONS

(75) Inventors: Jean-Philippe Deblander, Strasbourg (FR); Anett Borgwardt, Buehl (DE); Michael Cromack, La Wantzenau (FR)

(73) Assignee: Dow Global Technologies LLC, Midland, MI (US)

( * ) Notice: Subject to any disclaimer, the term of this patent is extended or adjusted under 35 U.S.C. 154(b) by 600 days.

(21) Appl. No.: 12/296,331

(22) PCT Filed: Apr. 26, 2007

(86) PCT No.: PCT/IB2007/002587

§ 371 (c)(1), (2), (4) Date: Jul. 1, 2010

(87) PCT Pub. No.: WO2008/012680

PCT Pub. Date: Jan. 31, 2008

(65) Prior Publication Data

US 2010/0275543 A1 Nov. 4, 2010

Related U.S. Application Data

(60) Provisional application No. 60/795,464, filed on Apr. 27, 2006.

(51) Int. Cl.
*E04B 1/74* (2006.01)

(52) U.S. Cl.
USPC ..... 52/404.1

(58) Field of Classification Search ..... 52/404.1, 52/406.1, 407.1, 404.2, 404.4, 404.5
See application file for complete search history.

(56) References Cited

U.S. PATENT DOCUMENTS

| | | | |
|---|---|---|---|
| 4,118,531 | A | 10/1978 | Hauser |
| 4,129,675 | A | 12/1978 | Scott |
| 4,304,817 | A | 12/1981 | Frankosky |
| 4,588,635 | A | 5/1986 | Donovan |
| 4,666,763 | A | 5/1987 | King |
| 4,762,749 | A | 8/1988 | Shuetz |
| 4,833,013 | A | 5/1989 | Schuetz |
| 4,992,327 | A | 2/1991 | Donovan |
| 5,114,787 | A | 5/1992 | Chaplin |
| 5,399,423 | A | 3/1995 | McCullough |
| 5,407,739 | A | 4/1995 | McCollough |
| 5,437,909 | A | 8/1995 | Herzberg |
| 5,437,922 | A | 8/1995 | Jackson |
| 5,443,893 | A | 8/1995 | Herzberg |
| 5,582,905 | A | 12/1996 | Beck |
| 5,597,427 | A | 1/1997 | Herzbert |
| 5,698,298 | A | 12/1997 | Jackson |
| 5,723,290 | A | 3/1998 | Borger |
| 2003/0022580 | A1 | 1/2003 | Bogrett |
| 2003/0176131 | A1 | 9/2003 | Tilton |
| 2004/0132375 | A1 | 7/2004 | Fukuhara |

FOREIGN PATENT DOCUMENTS

| | | | |
|---|---|---|---|
| EP | 297 187 | A | 1/1989 |
| EP | 217 484 | B | 7/1993 |
| EP | 364 194 | B | 2/1994 |
| WO | 99/64656 | A | 12/1999 |
| WO | 03/087814 | A | 9/2003 |

*Primary Examiner* — Mark Wendell
(74) *Attorney, Agent, or Firm* — Gary C Cohn PLC

(57) ABSTRACT

Fiber insulation batts suitable for building thermal insulating applications are made using polymer fibers. A mixture of staple fibers and binder fibers are used to make the batt. The batt has a bulk density of 5-15 kg/m3, a thermal conductivity of 30-50 mW/m-K and a lambda*density value of from 250-550. The batts can be made by forming a web of the fibers, and calibrating and heat-setting the web. The web can be formed using pneumatic or mechanical carding processes. In some processes, the batt can be made by forming a stack of multiple plies of the web and calibrating and heat-setting the stack.

18 Claims, No Drawings

POLYMERIC FIBER INSULATION BATTS FOR RESIDENTIAL AND COMMERCIAL CONSTRUCTION APPLICATIONS

This application claims benefit of U.S. Provisional Application No. 60/795,464, filed 27 Apr. 2006.

The present invention relates to polymer fiber insulation batts.

Thermal insulative batting materials are widely used in applications that are as diverse as textiles and building insulation. Because of the wide range of applications for these batting materials, a variety of insulative batting materials have been developed to meet specific market needs. This can be illustrated by reference to two primary markets for thermal insulating materials—textiles on the one hand, and building insulation on the other.

For centuries, the material of choice for textile applications was down. Down offers very good thermal insulation properties, and is well-known for its soft feel and good cushioning properties. The main problem with down is its high cost. The high cost of down now restricts its use almost exclusively to higher-end textile applications.

Therefore, much effort has gone into developing less-expensive alternatives to down for textile applications. The challenge has been to develop materials that provide comparable thermal insulation properties, are light in weight, and have acceptable tactile properties. Tactile properties are quite important in textile applications, as they affect both comfort and aesthetics. Clothing must "hang" well so it looks attractive and is comfortable when worn. Bedding materials (blankets, mattress pads, comforters, sleeping bags, for example) also must be comfortable to use. These attributes are sometimes expressed as the "drape" or "feel" of a textile.

Insulative batting based on organic polymer fibers have been developed to meet the needs of the textile industry. These batting materials can be described generally as webs made from a fiber mixture that includes one or more crimped staple fibers and a binder fiber. In most cases, the web is heat-set to bind the fibers together into a more cohesive mass. Examples of such batting materials are described in a variety of references, including, for example, U.S. Pat. Nos. 4,118,531, 4,129,675, 4,304,817, 4,588,635, 4,992,327, 5,437,909, 5,437,922, 5,443,893, 5,582,905, 5,597,427 and 5,698,298, as well as EP 0217484B1. Fiber thickness has been shown to play a role in thermal insulative properties as well as the tactile properties of the batting. For this reason, fiber diameters in the 3-12 micron range are used predominantly in these batting materials, although these are sometimes used in admixture with larger fibers.

Demands for building insulation materials are much different than for textile applications. Tactile qualities are minimally important for building insulation materials, so the focus of these materials is their insulative properties and ease of use. Cost is also a primary consideration in building insulation applications, much more so than in the textile industry. In textiles, the cost of raw materials such as fibers or down represents only a small fraction of the overall cost of the final product. For that reason, cost differences between alternative materials in many cases will not drive the selection of one material over another, if important properties are sacrificed as a result. This is not the case for construction materials, where cost is often a predominant consideration in selecting materials for building applications.

Because of the unique demands placed upon building insulation applications, and the focus on low cost, building insulation application materials have been dominated by foam board insulation on the one hand, and fiberglass or mineral wool batting on the other. Fiberglass and mineral wool are both relatively inexpensive and can provide good thermal insulation. However, these materials are irritants, and can cause injury to skin, eyes, and lungs (if inhaled, as is often the case). Skin, eye and inhalation protection should be worn when working with fiberglass or mineral wool batt insulation.

Fiberglass insulation tends to be hard to work with, because it is very flexible at the densities used in building insulation applications. As a result, sections of fiberglass insulation with useful thicknesses and lengths for most cavity insulation applications cannot support their own weight. Most fiberglass insulation batting has the additional disadvantage of not tearing easily in more or less straight line. When most fiberglass insulation is installed vertically or overhead, it must be held in place manually until fastened into place (typically with staples when a vapor barrier is attached to the product). This makes it difficult for one person to install. The added labor increases installation costs. A stiffer product is in some ways easier to install, especially in vertical installations, as it can be put into place and "stand" there with little or no support until fastened (if fastening is even necessary).

Another important consideration in the building trade is how well a particular batting material recovers from compressive forces. Fiber batts for construction applications are almost always stored and transported in compressed form, to reduce storage and transportation costs. Fiberglass insulation, for example, is commonly sold as a rolled good, in which the batt is compressed to one-fourth or less of its fully expanded thickness. In some areas, insulation batts are sold in pre-cut, lengths and widths which correspond to standard wall heights and frame member spacings. In such cases, the batts are often stacked into bundles and compressed to reduce their thickness. When the insulating batt is unpackaged, and the compressive forces removed, it is important that the batt recovers to its nominal thickness. If it cannot do so, it will not provide the desired thermal resistance.

Because of the shortcomings of fiberglass and mineral wool battings, an alternative product would be desirable. Synthetic polymer fibers such as polyesters are less irritating, so their use in such applications would be desired for that reason, if a batt could be produced that meets other requirements. One of the main problems is the cost of the fibers. Most synthetic polymer fibers are expensive, relative to fiberglass or mineral wool. A successful batting product made from synthetic polymer fibers would have to be very light in weight to compensate for the higher fiber cost. However, the need for a low density product must be balanced with other necessary characteristics as have been mentioned before.

There have been attempts to produce a synthetic fiber batting for building insulation applications, but so far these products have not been successful in meeting both performance and cost expectations. Such a product is described in U.S. Pat. No. 5,723,209. That product is described as a rollable insulation material made from polyester fibers. U.S. Pat. No. 5,723,209 describes a batting that exhibits a thermal conductivity (lambda value) of 35-40 mW/m-K, and which has a density of 27 kg/m$^3$. US 2004/0132375 describes a batting having densities of about 19 kg/m$^3$ or higher, that exhibit lambda-density values of over 870. In addition, several commercially available poly(ethylene terephthalate) fiber batting products are sold into construction applications. These include those sold as QUIETSTUF ABB, by Autex (New Zealand), the EDILFIBER products, sold by ORV Manufacturing SPA, in Italy, and products sold by Caruso GmbH of Germany. These products tend to have densities in the range of 16-30 kg/m$^3$ and have lambda values in the range of about 35 to 45 mW/m-K. One QUIETSTUF ABB product has a density of only 11.6 kg/m$^3$ but exhibits a lambda value of 53 mW/m-K. Because of the high densities of most of these products, their cost is too high to compete with fiberglass or mineral wool battings. As shown by the QUIETSTUF ABB materials, reducing density increases thermal conductivity, so a combination of low density and good thermal conductivity is not achieved by these materials.

In addition, a polymeric fiber batt fleece material made from a mixture of staple and bicomponent fibers is described in DE 19840050. This fleece is described as being useful in acoustical damping applications.

Therefore, it would be desirable to provide an insulating batt adapted for residential and commercial construction applications, which provides good thermal insulation properties, low cost, good recovery from applied compressive forces, and which preferably is somewhat stiff and so can be installed easily in vertical or overhead installations.

In one aspect, this invention is a compressible polyester fiber thermal insulation batt formed of entangled and melt-bonded polyester fibers, the polyester fibers including from 55-85% by weight of at least one staple fiber and from 15-45% by weight of at least one binder fiber, wherein the average fiber diameter is from 7.0 to 20.5 microns and at least 55% by weight of the fibers are crimped, wherein the insulation batt A) has an uncompressed bulk density of from 5 to 15 kg/m$^3$, B) exhibits a lambda value of from 30-50 mW/m-K, C) exhibits a lambda*density value of from 250-550 when lambda is expressed in units of mW/m-K and density is expressed in units of kg/m$^3$, D) has an uncompressed thickness of from 25-300 mm and E) exhibits a tensile stress of at least 4 kPa in at least one of the machine and cross-machine directions. The insulation batt advantageously recovers at least 70%, preferably at least 85%, of its initial thickness within 30 minutes after being compressed to 25% of its original thickness for a period of 11 days.

In another aspect, this invention is a compressible polyester fiber thermal insulation batt formed of entangled and melt-bonded polyester fibers, the polyester fibers including from 55-80% by weight of at least one staple fiber and from 20-45% by weight of at least one binder fiber, wherein the average fiber diameter is from 12.0 to 20.5 microns and at least 55% by weight of the fibers are crimped, wherein the insulation batt A) has an uncompressed bulk density of from 6 to 14 kg/m$^3$, B) exhibits a lambda value of from 35-50 mW/m-K, C) exhibits a lambda*density value of from 250-550 when lambda is expressed in units of mW/m-K and density is expressed in units of kg/m$^3$ and D) has an uncompressed thickness of from 25-300 mm In a third aspect, the invention is a polyester fiber thermal insulation batt in the form of a boardstock having an uncompressed thickness of from 25 to 300 mm, the batt exhibiting an overhang deflection value of 240 mm or less, wherein the batt is formed of entangled and melt-bonded polyester fibers, the polyester fibers including from 55-85% by weight of at least one staple fiber and from 15-45% by weight of at least one binder fiber, wherein the average fiber diameter is from 7.0 to 20.5 microns and at least 55% by weight of the fibers are crimped, and the insulation batt A) has an uncompressed bulk density of from 5 to 15 kg/m$^3$ and B) exhibits a lambda value of from 30-50 mW/m-K.

In yet another aspect, the invention is a polyester fiber thermal insulation batt in the form of a boardstock having an uncompressed thickness of from 25 to 300 mm, the batt exhibiting an overhang deflection value of 240 mm or less, wherein the batt is formed of entangled and melt-bonded polyester fibers, the polyester fibers including from 55-80% by weight of at least one staple fiber and from 20-45% by weight of at least one binder fiber, wherein the average fiber diameter is from 12.0 to 20.5 microns and at least 55% by weight of the fibers are crimped, and the insulation batt A) has an uncompressed bulk density of from 6 to 14 kg/m$^3$ and B) exhibits a lambda value of from 35-50 mW/m-K.

In still another aspect, this invention is a rolled polyester fiber thermal insulation batt, the batt having an uncompressed thickness of from 25 to 300 mm, and an uncompressed bulk density of from 5 to 15 kg/m$^3$, said batt being compressed in the roll to 25% or less of its uncompressed thickness, wherein the polyester batt is formed of entangled and melt-bonded polyester fibers, the polyester fibers including from 55-85% by weight of at least one staple fiber, and from 15-45% by weight of at least one binder fiber, wherein the average fiber diameter is from 7.0 to 20.5 microns and at least 55% by weight of the fibers are crimped, and further wherein the insulation batt upon unrolling and re-expansion exhibits a lambda value of from 30-50 mW/m-K.

In yet another aspect, this invention is a rolled polyester fiber thermal insulation batt, the batt having an uncompressed thickness of from 25 to 300 mm, and an uncompressed bulk density of from 6 to 14 kg/m$^3$, said batt being compressed in the roll to 25% or less of its uncompressed thickness, wherein the polyester batt is formed of entangled and melt-bonded polyester fibers, the polyester fibers including from 55-80% by weight of at least one staple fiber, and from 20-45% by weight of at least one binder fiber, wherein the average fiber diameter is from 12.0 to 20.5 microns and at least 55% by weight of the fibers are crimped, and further wherein the insulation batt upon unrolling and re-expansion exhibits a lambda value of from 35-50 mW/m-K.

This invention is a wall, ceiling, roof or floor construction comprising at least one major surface joined to a frame structure that includes at least two generally parallel frame members, the frame members and said at least one major surface defining at least one cavity, wherein the cavity is substantially filled with a polyester fiber thermal insulation batt of the invention.

This invention is also a method for insulating a wall, ceiling, roof or floor construction having one or more cavities defined by at least one major surface that is joined to a frame structure that includes at least two generally parallel frame members, comprising inserting into at least one such cavity a polyester fiber thermal insulation batt of the invention.

The invention is also a method for producing an insulation batt, comprising:

A. forming a web of entangled polyester fibers by pneumatic carding, the polyester fibers including from 55-85% by weight of at least one staple fiber and from 15-45% by weight of at least one binder fiber, wherein the average fiber diameter is from 7.0 to 20.5 microns and at least 55% by weight of the fibers are crimped; and B. calibrating and heat-setting said web to form an insulation batt containing entangled and heat-bonded polyester fibers.

The invention is also a method for producing an insulation batt, comprising:

A. forming a web of entangled polyester fibers by pneumatic carding, the polyester fibers including from 55-80% by weight of at least one staple fiber and from 20-45% by weight of at least one binder fiber, wherein the average fiber diameter is from 12.0 to 20.5 microns and at least 55% by weight of the fibers are crimped; and B. calibrating and heat-setting said web to form an insulation batt containing entangled and heat-bonded polyester fibers.

The invention is also a method for producing an insulation batt, comprising

A. forming multiple sections of a web of entangled polyester fibers, the polyester fibers including from 55-85% by weight of at least one staple fiber and from 15-45% by weight of at least one binder fiber, wherein the average fiber diameter is from 7.0 to 20.5 microns and at least 55% by weight of the fibers are crimped, the web of entangled polyester fibers having a weight of about 5 to 60 g/m$^2$;

B. forming a stack of said multiple web sections; and

C. calibrating and heat-setting said stack of web sections to form an insulation batt containing multiple individual plies of entangled and heat-bonded polyester fibers, each individual ply having a thickness of from 0.36 to 10.0 mm.

The invention is also a method for producing an insulation batt, comprising

A. forming multiple sections of a web of entangled polyester fibers, the polyester fibers including from 55-80% by weight of at least one staple fiber and from 20-45% by weight of at least one binder fiber, wherein the average fiber diameter is from 12.0 to 20.5 microns and at least 55% by weight of the fibers are crimped; the web of entangled polyester fibers having a weight of about 5 to 60 g/m$^2$;

B. forming a stack of said multiple web sections; and

C. calibrating and heat-setting said stack of web sections to form an insulation batt containing multiple individual plies of entangled and heat-bonded polyester fibers, each individual ply having a thickness of from 0.36 to 10.0 mm.

The polymer fiber batt of the invention is made from a mixture of synthetic polymer staple fibers, binder fibers. At least a portion of the fibers are crimped. The fibers are entangled and melt-bonded.

The staple fibers are characterized in having a length (at full extension, if crimped as described below) of from about 25 mm to about 300 mm, preferably from about 25 mm to about 150 mm, and especially from 30 to 75 mm. The staple fibers may be hollow or solid. They may have a circular cross-section or more complex cross-sectional shape (such as elliptical, multi-lobed and the like).

Binder fibers provide a melt-bonding function. A binder fiber, or at least a portion of the surface thereof, has a softening temperature which is lower than the softening temperature of the staple fiber(s). "Softening temperature" in this context means a temperature at which a fiber (or portion thereof) becomes soft enough as to become tacky and capable of adhering to another fiber in the fiber batt. The softening temperature of the binder fibers (or at least a portion of the surface of the binder fiber) is below that of the staple fibers. This permits the binder fibers to become softened during the heat-setting step (described below) without also softening the staple fibers. The difference in the softening points is large enough that the heat-setting process can be controlled easily to soften only the binder fiber (or low-softening portion thereof) without softening the staple fiber(s). A difference in softening temperatures of at least 5° C., preferably of at least 10° C., and especially of at least 30° C., is generally suitable.

Preferred binder fibers are so-called "multicomponent" (sometimes referred to as "bicomponent" or "conjugated") fibers made up of at least two sections. At least one of the sections is a lower-softening material, as just described. Such a section constitutes at least a portion of the surface of the multicomponent fiber. At least one other section is of a higher-softening material, which softens at a somewhat higher temperature, which allows the lower-softening material to be softened during the heat-setting process without softening the higher-softening portion of the fiber. As before, a difference of at least 5° C. and preferably at least 10° C., between the softening temperatures generally will permit the process to be controlled easily. The sections of the multicomponent fiber may be arranged in a side-by-side configuration, a sheath-core configuration, or in a wide variety of other configurations, provided that the lower-softening material forms at least a portion of the surface of the fiber.

A multicomponent fiber is a preferred type of binder fiber because in the melt bonding step, only the lower-melting section(s) of the fiber become softened, whereas the higher-melting sections retain their shape. After melt-bonding, the higher-melting sections of the multicomponent fibers therefore contribute to the loft of the batt and to its ability to recover from compression.

The binder fiber suitably has a length as described with respect to the staple fibers. The binder fiber may be solid or hollow, and may have a circular or other cross-section, as described with respect to the staple fibers.

The weight ratio of staple fibers to binder fibers is suitably from 55:45 to 80:20. A preferred weight ratio of staple fibers to binder fiber is from 65:35 to 80:20. Within these ranges, a good balance of recovery from compression, thermal insulative properties (expressed as lambda value according to the test method described below) and lambda*density are obtained. It is within the scope of the invention to use a combination of two or more staple fibers and/or two or more binder fibers to make up the batt.

At least 55% by weight of the fibers used to make the batt are crimped. Crimping improves the ability of the fibers to form a low density batt, and improves the ability of batts made in a carded or cross-lap process to recover from applied compressive forces. The crimping may be mechanical crimping, spiral crimping, or another type. A fiber may have a combination of two or more types of crimping. Mechanically crimped fibers suitably have a crimp density of from 1 to 30 per 25 mm, preferably from 2 to 30 per 25 mm and especially from 4 to 20 per 25 mm. Preferably, at least 70% by weight of the fibers are crimped, and up to 100% by weight of the fibers may be crimped. At least a portion of the staple fibers are crimped, and it is preferred that at least 50%, especially at least 75% and most preferably at least 95% by weight of the staple fibers are crimped. All of the staple fibers may be crimped. The crimped fibers may be lazy (1 to 2 per 25 mm), low (2-10 per 25 mm), standard (10-15 per 25 mm) or highly crimped (>25 per 25 mm) fibers. The desired degree of crimp may be affected by whether the batt is produced using an air lay or a carded and cross lapped process. The binder fibers may be crimped or not, but it is preferred that at least a portion, if not all, of the binder fibers are crimped.

The staple fibers are of one or more thermoplastic organic polymers that have a softening temperature that is at least 5° C., preferably at least 10° C., higher than the softening temperature of the lower-melting section of the binder fiber. A preferred organic polymer is a polyester, particularly a polyester corresponding to the reaction product of an aromatic diacid, an aromatic diacid ester, or an aromatic acid anhydride with an aliphatic diol or polylactic acid. An especially preferred polyester is polyethylene terephthalate.

The binder fiber similarly is composed of one or more thermoplastic organic polymers, provided that at least a portion of the binder fibers is composed of a lower-softening material as described before. A wide range of combinations of higher- and lower-softening materials can be used to make the binder fiber. For example, a polyester can be used as the higher-softening component of the fiber, and the lower-softening component may be a lower-softening polyester, a polyolefin, or a polyamide. The lower-softening material is preferably a polyester corresponding to the reaction product of an aromatic or aliphatic diacid, and aromatic or aliphatic diacid ester or an aromatic or aliphatic acid anhydride with an aliphatic diol, or polylactic acid. Amorphous or semicrystalline polyesters can be used as the components of the binder fiber. For example, the low melting-point polyester may be a copolymerized ester containing any of aliphatic dicarboxylic acids, such as adipic acid and sebacic acid, aromatic dicarboxylic acids, such as phthalic acid, isophthalic acid, naphthalenedicarboxylic acid, and/or alicyclic dicarboxylic acids, such as hexahydroterephthalic acid and hexahydroisophthalic acid, and any of aliphatic groups and alicyclic diols, such as diethylene glycol, polyethylene glycol, propylene glycol, and p-xylylene glycol with any of oxyacids, such as p-hydroxybenzoic acid, added according to the requirement. For example, the low-melting point polyester may be prepared by copolymerizing terephthalic acid and ethylene glycol with isophthalic acid and 1,6-hexanediol added.

Examples of useful multicomponent fibers are described in US 2004/0132375 and U.S. Pat. No. 4,950,541.

A preferred batt of the invention includes polyester staple fibers and polyester binder fibers, wherein the polyester resin in the binder fiber is a lower-softening resin as described before.

A more preferred batt of the invention includes polyester staple fibers and optional stiffening fibers and a multicomponent binder fiber having at least one higher-softening polyester segment and at least one segment of a lower softening organic polymer. An especially preferred lower-softening organic polymer is most preferably also a polyester polymer. Softening temperatures for polyester resins depend somewhat on resin molecular weight, with low molecular weight polyester resins having a lower softening point than some higher molecular weight polyester resins. Thus, a relatively low molecular weight polyester resin is used in especially preferred embodiments as the low-softening segment of the multicomponent fiber, and a higher molecular weight polyester resin is used to form the staple fiber and higher-softening portions of the multicomponent binder fibers.

The organic polymer(s) used to form the staple and/or binder fibers may contain additional ingredients. Examples of such additional ingredients include, for example, plasticizers, dyes, pigments, opacifying agents, antioxidants, biocidal agents, and infrared absorbing agents.

Fibers containing infrared absorbing agents are of particular interest to the invention, as the presence of infrared absorbing agents can further improve the thermal insulative characteristics of the batt. Suitable infrared absorbing agents are materials that absorb infrared radiation and can dissipate the absorbed energy in another form (such as heat). The infrared absorbing agent may be soluble in the polymer component of the resin. Alternatively, it may be a solid having a particle size that is small enough that a blend of the agent in the polymer can be formed into the fine diameter fibers used in the invention (as described more below). Infrared absorbing agents of particular interest include carbonaceous particulate materials such as carbon black or furnace black, as well as materials such as calcium carbonate. Infrared absorbing materials should have a particle size which is preferably less than ¼ of the fiber diameter and more preferably less than one tenth of the fiber diameter. Carbonaceous particulate materials are less preferred when a white or lightly colored batt is desired, but are otherwise preferred when color is immaterial or when it does not interfere with obtaining the desired color. A fiber containing such infrared absorbing agent may contain any effective amount thereof, with an amount of from 1 to 10%, especially from 1.8 to 10% thereof, based on the weight of the fiber being particularly suitable. From 1 to 100%, preferably from 10 to 100%, more preferably 50 to 100% by weight of the fibers used to make the batt may contain an infrared absorbing agent. The infrared absorbing agent may be present in the staple fibers or binder fibers, or both.

Titanium dioxide may also be useful in small quantities as an infrared absorbing agent, and can also be used in somewhat greater quantities as a colorant or delustering agent.

The diameters of the staple fibers, the binder fibers and optional stiffening fibers are selected together so that the average fiber diameter is in the range of from 7.0 to 20.5 microns or from 12.0 to 20.5 microns. The average fiber diameter may be from 9 to 18 microns or from 13 to 18 microns. The average fiber diameter may be from 9 to 16 microns or from 12 to 16 microns. Fibers are commonly characterized by their "denier", which is defined as the weight in grams of 9000 meters of fiber. Denier is therefore a function of the cross-sectional area and density of the material For a polyester fiber with a solid, circular cross-section, a fiber diameter of from 9.6 to 20.5 microns corresponds to a denier of approximately 0.9 to 4, and a fiber diameter of from 12.0 to 20.5 microns corresponds to a denier of approximately 1.5 to 4.

For purposes of this invention, average diameter is determined according to the relation $$AverageDiameter = \frac{\sum \frac{x_n}{D_n * d_n}}{\sum \frac{x_n}{D_n^2 * d_n}}$$

where $x_n$ represents the weight fraction of fiber n, $D_n$ represents the diameter of fiber n and $d_n$ is the density of fiber n. This average diameter represents a weight average diameter.

As the average fiber diameter is increased above the foregoing ranges, it becomes difficult to achieve a lambda value of 50 mW/m-K at a batt density of 14 kg/m$^3$ or below. Low batt densities are important for cost considerations, as the raw material cost to produce a batt tends to decrease with decreasing batt weight. A useful indicator of the cost effectiveness of a batt is a lambda*density value, which is obtained for purposes of this invention by multiplying the lambda value of a batt by the density of the batt. By comparing lambda*density values for batts having similar lambda values, one can obtain a rough indication of the relative cost to produce different batts that provide similar insulation values. Batts according to the invention advantageously have the following combination of properties: A) uncompressed batt density of from 5 to 15 kg/m$^3$, B) lambda value of 30-50 mW/m-K and C) a lambda*density value in the range of 250-550, preferably 275-500, and especially 300-450, when lambda is expressed in units of mW/m-K and density is expressed in units of kg/m$^3$. Other batts according to the invention have the following combination of properties: A) uncompressed batt density of from 6 to 14 kg/m$^3$, B) lambda value of 35-50 mW/m-K and C) a lambda*density value in the range of 250-550, preferably 275-500, and especially 300-450, when lambda is expressed in units of mW/m-K and density is expressed in units of kg/m$^3$. Batts made with a greater average fiber thickness can exhibit lambda values in the range of 30-50 mW/m-K, but typically only at higher batt densities, and therefore at higher lambda*density values and higher raw material costs. Batts made using a lower average fiber thickness tend to exhibit lower loft and inferior compression recovery. Fiber costs also tend to increase when smaller diameter fibers are used in significant quantities.

Individual fibers within the batt may have diameters that are above, within or below the aforementioned ranges. Thus, a portion of the fibers may have diameters as small as 5 microns and up to 50 microns, or even more, provided that the average diameter remains as specified herein. In cases in which the staple fiber has a diameter of less than 12 microns, and especially in cases in which the staple fiber has a diameter of less than 7 microns, some fibers having a diameter of from 20 to 50 microns, preferably from 32 to 45 microns and more preferably from 35 to 43 microns are preferably included, provided that the average fiber diameter is as described before. The higher diameter fibers can compensate for loss of batt stiffness that is seen when low denier staple fibers are present in significant quantities. The higher diameter fibers should not constitute more than 25 wt %, preferably not more than 20 wt % and more preferably not more than 10 wt % of the total fiber weight.

For fibers that are not spherical in cross-section, the fiber diameter for purposes of this invention is taken to be of a circle having the same area as the cross-sectional area of the fiber.

The polymer batt is conveniently made by forming an entangled mixture of the constituent fibers to form a web, compressing ('calibrating') the web to the desired density, and then heat-setting the web to form the polymer batt.

A web of entangled fibers is conveniently prepared by "carding" or "garnetting" processes, each of which is well-known and used commercially to produce a variety of types of fiber web products. Carding can be done mechanically or via a pneumatic carding (also known as an air-lay) process. The web can be produced at any convenient thickness (subject to equipment limitations), and taken directly to a calibration and heat setting step in order to form a batt of desired density. Suitable equipment for pneumatic carding includes that sold under the trade name AirWeb by Thibeau Corporation France, as well as pneumatic carding devices manufactured or marketed by Rando Webber, Chicopee, Fehrer, Hergeth, Laroche, Schirp and Massias. Methods for using such equipment to form fiber webs are also described in "Clemson University Dry Laid Nonwovens Laboratory Facilities", Fall 2004. When mechanical carding or garnetting processes are used, it is preferred to produce the batt by forming a number of plies which are stacked together before being calibrated and heat set as a unit. Layering can be done longitudinally, or by crosslayering (sometimes referred to as cross lapping). Both processes are well known and are used to make conventional types of batting.

It has been found that in some cases, batts formed using a higher number of plies have lower thermal conductivities and have greater stiffness. In a preferred process, individual plies are formed, at a weight of from about 5 to 60, especially from about 8 to 50, and most preferably from about 10 to 40 g/m$^2$. During the calibration and heat setting step, plies in this weight range are compressed to an individual ply thickness in the range of from 0.36 to about 10.0, especially from about 0.57 to about 5.0, and more preferably from about 0.71 to about 4.0 mm. The number of plies that are required is therefore determined by the thickness of the batt and the compressed thickness of the individual plies.

The web (being a single layer or a stack of multiple plies) is then calibrated to a density of 5-15 kg/m$^3$, preferably from 6-15 kg/m$^3$ and more preferably from 6 to 14 kg/m$^3$, and heat set while under compression. An even more preferred calibrated density is from 7-13 kg/m$^3$. Heat setting is accomplished by heating the calibrated web to a temperature at which the lower-softening surface of the binder fiber becomes softened, but at which the staple fiber (and higher-melting portion(s) of the binder fiber in the case of a multicomponent fiber) do not become softened. The softened binder fiber becomes tacky when softened, and sticks the binder fiber to adjacent fibers in the web. The web is then cooled, it being kept under compression until the softened binder fiber rehardens and forms an adhesive bond with adjacent fibers. After the binder fiber rehardens, compression can be released and the resulting batt will retain the thickness to which it was compressed for heat setting.

The thickness of the calibrated and heat-set batt so produced is referred to herein as its "uncompressed" thickness, as this thickness represents the thickness of the batt at its full expansion. Batts of the invention have an uncompressed thickness of from 25 to 300 mm (approximately 1 to 12 inches). Preferred batts have an uncompressed thickness of from 25 to 250 mm (approximately 1 to 10 inches). Even more preferred batts have an uncompressed thickness from 75 to 200 mm (approximately 3 to 8 inches).

The somewhat large thicknesses of the batts of the invention make the batts particularly suitable as thermal insulation materials for building applications. Batts for these applications are often packaged for transport and sale in either of two product forms—boardstock and rollstock.

Boardstock refers to batts that are manufactured in predetermined lengths and widths which are adapted to fit within cavities in a wall, ceiling, roof, floor or other construction. These cavities are formed by the frame members (in wall constructions these are typically referred to as "studs" and "headers") that form the support structure for these constructions. The widths of these boardstocks typically are in the range of 150 to 600 mm, and are generally selected to reflect the spacing between stud members in a frame construction. Thus, in the United States, a common stud spacing is 16 inches (about 406 mm) (center to center) for walls of frame construction or 24 inches (about 610 mm) for rafter joist spacing. Batts in the form of boardstock would have a corresponding width of approximately 14½ inches (about 370 mm), or 22½ inches (about 570 mm) respectively, to fit within and fill the space between adjacent frame members in such a wall or ceiling. Similarly, the thickness of the batt is often adapted to approximate the thickness of the studs (often 3½ inches (about 89 mm) in wall constructions in the United States, and somewhat thicker in roof, ceiling and floor constructions), so the batt will fill cavities formed by the frame members. Thus, uncompressed thickness for boardstock is suitably from 25-300 mm, especially from 75-190 mm. Boardstock lengths are suitably chosen to fit within the frame members, with lengths of from 150 to 350 cm, especially from 230-300 cm, being common in United States frame constructions. These length and width dimensions are typical but not considered as limiting, as boardstock dimensions can vary widely to fit particular construction designs. Alternatively, boardstock dimensions may be chosen with handling considerations in mind, to create a product having a size and weight that can be managed easily by a single worker during installation.

Boardstock may or may not be a stiff material, although it is preferred that the batting of the invention is somewhat stiff, as that quality makes installation and handling much easier. Batt stiffness can be expressed in terms of how much the batt will bend under force of gravity. A suitable method for evaluating batt stiffness is an overhang deflection test. A section of batt having dimensions of 100 millimeters (mm)×500 mm is laid on a horizontal surface, so that 300 mm of its length extends beyond the edge of the surface and 200 mm of its length rests on the surface. A 100 mm×100 mm foam board is placed on top of the batt, and a 770 gram weight is placed on the foam board to keep the batt from moving. The foam board is positioned at the end of the test sample, so that, from the edge of the underlying surface, a 100 mm length of the batt is uncovered and free to move, and the next 100 mm length of the batt is held down by the board and weight. The unsupported end of the batt will become deflected, or sag, under the force of gravity. The amount of deflection (from the plane of the supporting surface) is reported in mm as an indication of the stiffness of the batt. The batt is then flipped over and the deflection remeasured in the opposite direction. In this test, a 40 mm thick batt suitably exhibits a deflection of less than 230 mm, preferably less than 180 mm and more preferably less than 120 mm. The deflection value may be as little as zero, but as a practical matter is more typically about 30 mm or more.

Because boardstock is prepared and sold in relatively short, predetermined lengths, it is typically not rolled but instead formed into stacks, which are then compressed as a bundle for packaging and transportation. A bundle typically contains from 5 to 20 individual batts. The compressed batts in the bundle are typically compressed to one-fourth to one-tenth of their original thickness.

Rollstock is generally packaged and sold in greater lengths, but product width and uncompressed thickness are typically determined by the same considerations as with boardstock—to fit within the cavities formed by the frame members of standardized frame constructions. The product is formed into rolls for storage and transportation due to its greater length. As with the boardstock, the product is compressed to a thickness that is typically one-fourth to one-tenth of its uncompressed thickness. Rollstock is also preferably somewhat stiff, but not so stiff that it cannot be rolled without causing permanent deformation or tearing. On the sag test described before, rollstock according to the invention suitably exhibits a deflection of less than 230 mm, especially less than 180 mm. Batting used as rollstock should be sufficiently flexible that it can be rolled with becoming permanently distorted (other than perhaps a small amount of compression).

If desired, one or more layers of a facing material may be applied to one or both sides of the batt. Examples of such facing materials include paper (especially Kraft paper), plastic film, a metal foil (such as aluminum foil), metallized film, or combinations thereof. Facing materials may be useful to provide enhanced stiffness, to provide a reflective surface, to provide a moisture or air barrier, or as a means for attaching the batt in place as it is installed.

The batt of the invention is conveniently installed as thermal insulation in building and construction applications in a manner similar to existing boardstock and rollstock insulation products. Once compressive force is released from the packaged batt, it will expand to recover to its design thickness. It is not necessary to wait for the batt to fully decompress to install it. The cavity to be insulated is in many building applications defined by at least one major surface that is joined to a frame structure. The frame structure includes at least two generally parallel frame members. The width of the cavity is determined by the spacing of the frame members. The depth of the cavity is defined by the thickness of the frame members. The frame structure may include headers at top and/or bottom, as well as at intermediate heights. The distance between headers determines the height of the cavity. After the batt of the invention is installed into the cavity, the cavity may be enclosed by affixing a second major surface to the frame structure. Structures that are commonly assembled in this manner include walls, floors, ceilings, and roofs (which can be pitched or flat, or horizontal), particularly of buildings of frame construction. These may be exterior or interior structures.

A compressed batt of the invention recovers most or all of its uncompressed thickness within a short period after the compressive forces are released. A convenient measure of the ability of the batt to recover from compression is to compress it to 25% of its original thickness for a period of 11 days. This simulates packaging and warehousing conditions which are common in the construction industry. A batt of the invention typically will recover at least 70% of its uncompressed thickness within 30 minutes. It preferably will recover at least 80%, more preferably at least 85%, of its uncompressed thickness within 30 minutes. The batt preferably will recover at least 80%, more preferably at least 90%, even more preferably at least 95%, of its uncompressed thickness within 24 hours. Typically, the product will be manufactured at a design or nominal thickness that is from 80-99%, more typically 90-99%, especially from 95-99% of the uncompressed thickness described before. This allows for a small amount of permanent compression to occur in goods that are compressed for storage and shipment, as described before.

It has also been found that batts of the invention which are made by a cross-lapping process are often easily tearable and that when torn using an "in plane" tearing method, often tear cleanly and approximately in a straight line. The ability to be torn easily and in a straight line is of great benefit during installation, during which it is convenient to simply tear the product to fit it around irregularities in the cavity (such as cables, piping, junction boxes and the like). "In plane" tearing refers to a method whereby the two sides are simply parted by pinching or compressing the fiber batt thickness and separating the two sides of the separation in a linear motion. The line of separation can then be extended as the material intrinsically cleaves.

The batts of the invention also tend to have good tensile and elongation properties. Tensile stress in the batts may be somewhat anisotropic. Whether higher tensile stress and lower elongation are seen in the machine direction, as compared to the cross-machine direction depends on the process and process conditions. The batt of the invention should have a tensile stress of at least 4 kPa in at least one of the machine and cross-machine directions, preferably in both the machine and cross-machine directions. It preferably has a tensile stress of at least 25 kPa in one of either the machine or cross direction. Elongation may be from 25-125% in each direction.

The following examples are provided to illustrate the invention, but are not intended to limit the scope thereof. All parts and percentages are by weight unless otherwise indicated.

EXAMPLES 1-5

The following lab-scale batt production process is used to make Batt Examples 1-3.

Fibers are received in large bales. Fibers of each type are weighed and mixed by hand at the proportions indicated below. The hand-blended fibers are dropped onto a conveyor which transports the fiber to a carding device which grabs, fluffs and entangles the fibers to produce a carded web 400 mm wide. The web so produced weighs about 10 g/m$^2$. The carded web is wound around a drum of greater than 600 mm circumference as it is produced. The wound web is then slit to remove it from the drum, with about 600 mm long sections being produced in this manner.

For Example 1, about 85 of the 400 mm×about 600 mm sections so produced are stacked. The stack is then compressed to a thickness of 100 mm and heat set by heating the stack at 170° C. for 60-90 seconds. Individual layer thickness in the calibrated and heat-set batt is approximately 1.18 mm. The batt is then cut to final dimensions of 400×600 mm.

Batt Example 2 is made in the same way, using about 110 of the web sections. Individual layer thickness in the final batt is approximately 0.91 mm. Batt Example 3 is also made in the same way, using about 125 of the web sections. Individual layer thickness in the final batt is approximately 0.8 mm.

In Examples 1-3, the fibers used to make the batt are a 2 denier polyethylene terephthalate/polyethylene terephthalate sheath/core bicomponent fiber and a 3 denier sawtooth crimped polyethylene terephthalate staple fiber. The fibers are used at a 40/60 weight ratio to produce an average fiber diameter of 16.0 microns. The carded webs have the densities indicated in Table 1 below.

Batt Example 4 is made by forming two portions of batt Example 1 and stacking to form a 200-mm thick sample. Individual layer thickness for batt Example 4 is approximately 1.16 mm.

Batt Example 5 is made by stacking two 100-mm batts to form a 200-mm thick sample. The 100-mm batts are made in the general manner described for Examples 1-3, in each case stacking approximately 100 layers of the web sections. Individual layer thickness is approximately 0.99 mm.

Thermal conductivity of the finished batts is measured according to EN ISO 8301-91 at 10° C. Density is measured by weighing the batt, calculating the volume of the batt and dividing the weight by the volume. Lambda*density is determined by multiplying the lambda value in mW/m-K by the density in kg/m$^3$. Results are as indicated in Table 1 below.

EXAMPLES 6-7

The following large-scale batt production process is used to make batt Examples 6-7.

Fiber bales are processed to a bale opener and blender where the fibers are blended in proportions as indicated below. The fiber mix then enters a carding machine that entangles the fibers to produce a web of 10-20 mm thickness and 4000 mm width. The web is conveyed to a cross-lapper which assembles 72 layers (in the case of Example 6) or 64 layers (in the case of Example 7) of the web into a stack. The stack is then processed through a thermo-bonding oven in which the stack is compressed to the desired height and density and is heat set. After calibrating and heat setting, the thickness of the individual layers in the batt is approximately 2.5 mm.

In Examples 6-7, the fibers and their relative proportions are the same as in Examples 1-5, again resulting in an average fiber diameter of 16.0 microns.

Lambda, density and lambda*density are determine as described with respect to Examples 1-5, with results being as indicated in Table 1 below.

EXAMPLES 8-10

The lab-scale process as described for Example 5 is used to make batt Examples 8-10, with the following modifications. The fibers are the same as indicated for Examples 1-3, except that the fiber blend contains only 30% by weight of the bicomponent fiber and 70% of the staple fiber. Average fiber diameter is 16.3 microns. For Example 8, two 100-mm thick batts are prepared by stacking about 95 layers of the web, and calibrating and heat-setting. The two 100-mm calibrated and heat-set batts are then stacked to form a 200-mm batt. Individual layer thickness in batt Example 8 is about 1.05 mm. For Example 9, 100 web layers are stacked and formed into 100-mm calibrated and heat-set batts, two of which are again stacked to form a 200-mm material. In this case, individual layer thicknesses are about 1 mm. For Example 10, about 122 layers are used to form each 100-mm batt. Individual layer thickness is about 0.82 mm.

Lambda, density and lambda*density are determined as described with respect to Examples 1-5, with results being as indicated in Table 1 below.

EXAMPLES 11-13

The lab-scale process as described in Example 5 is used to make Batt Examples 11-13, with the following modifications. The fibers are a blend of 30% by weight of the bicomponent fiber described in Examples 1-5, and 70% by weight of a hollow spiral staple polyester fiber having a denier of 3. Average fiber diameter is 16.3 mm.

In the case of Example 11, about 100 layers of the web are stacked to form each 100-mm batt, and individual layer thickness in batt Example 11 is about 1 mm. For Example 12, about 120 layers of the web are stacked to form each 100-mm batt, and individual layer thickness in batt Example 12 is about 0.83. For Example 13, about 82 layers of the web are stacked to form each 100-mm batt, and individual layer thickness in batt Example 13 is about 1.22.

Lambda, density and lambda*density are determined as described with respect to Examples 1-5, with results being as indicated in Table 1 below.

EXAMPLE 14

Batt Example 14 is made in the same manner as Examples 1-3. The fibers in this case are a 40/60 by weight blend of the bicomponent fiber and staple fiber described in Examples 11-13. Average fiber diameter is 16.0 microns. 100 layers of web are stacked, calibrated and heat-set to form a 100 mm batt. Individual layer thickness in the calibrated and heat-set batt is 1.0 mm.

Lambda, density and lambda*density are determined as described with respect to Examples 1-5, with results being as indicated in Table 1 below.

EXAMPLES 15-19

Batt Examples 15-19 are made in the same general manner as Batt Examples 1-3. A different 3 denier staple polyethylene terephthalate fiber is used for these examples. In Example 15, the staple fiber is made of a polyethylene terephthalate containing 0.87% by weight $TiO_2$. In Example 16, the staple fiber is made of polyethylene terephthalate containing 0.87% by weight $TiO_2$ and a blue colorant. In Examples 17-19, the polyester staple fiber contains a black colorant. Average fiber diameter is 16.0 microns for Examples 15-19.

For Examples 15 and 16, 100 layers of web are stacked, calibrated and heat set to produce a 75-mm batt, in which individual layer thickness is about 0.75 mm.

In Examples 17-19, 200 mm batts are produced by stacking two 100-mm batts, in the manner described with respect to Examples 11-13. For Example 17, about 105 layers of web are used to make each 100-mm batt, and individual layer thickness is about 0.95 mm. For Example 18, about 125 layers of web are used to make each 100-mm batt, and individual layer thickness is about 0.8 mm. For Example 19, about 85 layers of web are used to make each 100-mm batt, and individual layer thickness is about 1.18 mm.

Lambda, density and lambda*density are determined as described with respect to Examples 1-5, with results being as indicated in Table 1 below.

EXAMPLES 20-21

Batt Examples 20-21 are made in the same general manner as batt Examples 1-3 using a blend of 30% by weight of a 2 denier polyethylene terephthalate/polyethylene terephthalate sheath/core bicomponent fiber, 35% of a spiral crimped, 3 denier polyethylene terephthalate staple fiber and 35% of a spiral crimped, 6 denier polyethylene terephthalate staple fiber. Average fiber diameter is 17.4 microns. 200-mm batts are produced in the manner described in Examples 11-13.

For Example 20, about 100 layers of web are used to make each 100-mm batt, and individual layer thickness is about 1.0 mm. For Example 21, about 130 layers of web are used to make each 100-mm batt, and individual layer thickness is about 0.77 mm.

Lambda, density and lambda*density are determined as described with respect to Examples 1-5, with results being as indicated in Table 1 below.

EXAMPLES 22-25

Batt Examples 22-25 are made in the same general manner as batt Examples 11-13 using a blend of 40% by weight of a 4 denier polyethylene terephthalate/polyethylene terephthalate sheath/core bicomponent fiber, and 60% of a black colored, spiral crimped, 3 denier polyethylene terephthalate staple fiber. Average fiber diameter is 18.5 microns.

For Example 22, about 75 layers of web are used to make each 100-mm batt, and individual layer thickness is about 1.33 mm. For Example 23, about 100 layers of web are used to make each 100-mm batt, and individual layer thickness is about 1.0 mm. For Example 24, about 125 layers of web are used to make each 100-mm batt, and individual layer thickness is about 0.8 mm. For Example 25, about 130 layers of web are used to make each 100-mm batt, and individual layer thickness is about 0.77 mm.

Lambda, density and lambda*density are determined as described with respect to Examples 1-5, with results being as indicated in Table 1 below.

EXAMPLES 26-28

Batt Examples 26-28 are made in the same general manner as batt Examples 1-3 using a blend of 40% by weight of the bicomponent fiber, 30% of a 3 denier hollow spiral crimped staple polyethylene terephthalate fiber and 30% of a spiral crimped, 1.5 denier polyethylene terephthalate staple fiber. Average fiber diameter is 14.3 microns.

Example 26 is made by forming 60-mm thick batts by stacking and calibrating and heat-setting about 50 layers of the web. Two of the 60-mm calibrated and heat-set batts are then stacked to form a 120-mm batt. Individual layer thickness in Example 26 is about 1.2 mm. Example 27 is made by forming 80-mm thick batts by stacking and calibrating and heat-setting 85 layers of the web. Two of the 80-mm calibrated and heat-set batts are then stacked to form a 160-mm batt. Individual layer thickness in Example 27 is about 0.94 mm. Example 28 is made by forming 100-mm thick batts by stacking and calibrating and heat-setting 120 layers of the web. Two of the 100-mm calibrated and heat-set batts are then stacked to form a 200-mm batt. Individual layer thickness in Example 28 is about 0.83 mm.

Lambda, density and lambda*density are determined as described with respect to Examples 1-5, with results being as indicated in Table 1 below.

EXAMPLE 29

Batt Example 29 is made using the lab scale process described with respect to batt Examples 11-13. The fiber blend is the same as described with respect to batt Examples 6-7, except the ratio is of 20% of the bicomponent fiber and 80% of the staple fiber. Average fiber diameter is 16.7 microns. Example 29 is made by forming 80-mm thick batts by stacking and calibrating and heat-setting about 87 layers of the web. Two of the 80-mm calibrated and heat-set batts are then stacked to form a 160-mm batt. Individual layer thickness in Example 29 is about 0.92 mm.

Lambda, density and lambda*density are determined as described with respect to Examples 1-5, with results being as indicated in Table 1 below.

Comparative Samples A-F

Comparative Samples A and B are made in the same manner as using the lab scale process described with respect to batt Examples 1-3. The fiber blend is 40% by weight of a 4 denier bicomponent fiber of the same type as that used in Examples 1-3, and 60% by weight of a 6 denier polyethylene terephthalate staple fiber containing 0.3 weight percent $TiO_2$. Average fiber diameter is 22.5 microns.

For Comparative Sample A, 105 layers of the web are stacked and calibrated and heat set to a thickness of 90 mm; individual layer thickness is about 0.86 mm. For Comparative Sample A, 100 layers of the web are stacked and calibrated and heat set to a thickness of 100 mm; individual layer thickness is about 1.0 mm. Calibrated batt density is 12.2 kg/m$^3$ for Comparative Sample A and 10.1 kg/m$^3$ for Comparative Sample B.

Comparative Samples C-G are commercially available polyester batting

| | |
|---|---|
| Comp. Sample C | Quietstuf ABB, 21 kg/m$^3$ density, Autex Industries |
| Comp. Sample D | Quietstuf ABB, 16 kg/m$^3$ density, Autex Industries |
| Comp. Sample E | EMFA, 16 kg/m$^3$ density, Emfa-Dammsysteme |
| Comp. Sample F | Caruso Iso-Bond, 20 kg/m$^3$ density, Caruso GmbH |
| Comp. Sample G | Edilfiber, 30 kg/m$^3$ density, ORV Manufacturing SPA |

Lambda, density and lambda*density are determined for each of these Comparative Samples as described with respect to Examples 1-5, with results being as indicated in Table 1 below.

TABLE 1

| Ex. No. | Wt-ave. Fiber Dia. (μm) | Bico/Staple Weight Ratio | Batt Thickness, mm | Batt density, kg/m$^3$ | Lambda, mW/m-K | Lambda* density |
|---|---|---|---|---|---|---|
| 1 | 16.0 | 40/60 | 100 | 8.5 | 44.2 | 375 |
| 2 | 16.0 | 40/60 | 100 | 11.0 | 39.9 | 439 |
| 3 | 16.0 | 40/60 | 100 | 12.3 | 38.8 | 477 |
| 4 | 16.0 | 40/60 | 200 | 8.6 | 45.0 | 387 |
| 5 | 16.0 | 40/60 | 200 | 10.1 | 41.8 | 417 |
| 6 | 16.0 | 40/60 | 180 | 11.2 | 43.0 | 482 |
| 7 | 16.0 | 40/60 | 160 | 12.8 | 40.5 | 518 |

TABLE 1-continued

| Ex. No. | Wt-ave. Fiber Dia. (μm) | Bico/Staple Weight Ratio | Batt Thickness, mm | Batt density, kg/m$^3$ | Lambda, mW/m-K | Lambda* density |
|---|---|---|---|---|---|---|
| 8 | 16.3 | 30/70 | 200 | 9.6 | 43.7 | 419 |
| 9 | 16.3 | 30/70 | 200 | 10.1 | 42.5 | 431 |
| 10 | 16.3 | 30/70 | 200 | 12.4 | 41.8 | 517 |
| 11 | 16.3 | 30/70 | 200 | 10.0 | 42.7 | 427 |
| 12 | 16.3 | 30/70 | 200 | 12.0 | 40.8 | 490 |
| 13 | 16.3 | 30/70 | 200 | 8.35 | 46.9 | 391 |
| 14 | 16.0 | 40/60 | 100 | 10.2 | 44.0 | 451 |
| 15 | 16.0 | 40/60 | 75 | 13.2 | 38.0 | 500 |
| 16 | 16.0 | 40/60 | 75 | 13.0 | 39.0 | 507 |
| 17† | 16.0 | 40/60 | 200 | 10.8 | 40.0 | 443 |
| 18† | 16.0 | 40/60 | 200 | 12.8 | 38.8 | 495 |
| 19† | 16.0 | 40/60 | 200 | 8.6 | 45.3 | 390 |
| 20 | 17.4 | 30/70 | 200 | 10.0 | 45.3 | 454 |
| 21 | 17.4 | 30/70 | 200 | 13 | 41.2 | 535 |
| 22† | 18.5 | 40/60 | 200 | 7.9 | 46.9 | 369 |
| 23† | 18.5 | 40/60 | 200 | 10.1 | 41.6 | 418 |
| 24† | 18.5 | 40/60 | 200 | 12.8 | 37.8 | 483 |
| 25† | 18.5 | 40/60 | 200 | 13.3 | 38.0 | 503 |
| 26 | 14.3 | 40/60 | 120 | 8.64 | 43.7 | 377 |
| 27 | 14.3 | 40/60 | 160 | 10.8 | 39.8 | 429 |
| 28 | 14.3 | 40/60 | 200 | 12.1 | 38.5 | 468 |
| 29 | 16.7 | 20/80 | 160 | 11.0 | 40.9 | 450 |
| Comp. A* | 22.5 | 40/60 | 90 | 12.2 | 46.1 | 563 |
| Comp. B* | 22.5 | 40/60 | 100 | 10.1 | 53.5 | 539 |
| Comp. C* | 23.8 | 25/75 | 48 | 21 | 40.7 | 856 |
| Comp. D* | 32.0 | 25/75 | 48 | 16 | 44.4 | 710 |
| Comp. E* | 19.6 | 30/70 | 100 | 16 | 40.7 | 616 |
| Comp. F* | 18.4 | 35/65 | 200 | 20 | 39 | 780 |
| Comp. G* | 23.4 | 40/60 | 80 | 30 | 39.6 | 1188 |

*Not an example of this invention.

†These examples are black and are made with fiber containing carbon black as a colorant.

Examples 1-29 illustrate that batts having low thermal conductivities (as indicated by low lambda values) can be obtained at low batt densities (as reflected by low lambda*density values) in accordance with the invention.

The effect of fiber diameter is seen with Comparative Samples A-D. These all have larger average fiber diameters than the inventive batts. Generally, the batts having a larger average fiber diameter can achieve low lambda values only at the expense of increased batt density, which results in higher cost. Thus, for example, batt Example 1 and Comparative Sample D have similar lambda values, but the lambda*density value for Comparative Sample D is much higher due to its higher density. Similar trends are seen by comparing Comparative Sample A with Example 13 and Comparative Sample C with Example 12.

Comparative Sample B illustrates how lambda values deteriorate as batt density decreases, when the average fiber diameter is large. The lambda value increases to 53.5 mW/m-K when batt density decreases from about 12 kg/m$^3$ (as in Comparative Sample A) to about 10 kg/m$^3$ (as in Comparative Sample B). This data indicates that batt densities of at least 11 kg/m$^3$ are needed to obtain a lambda value of 50 mW/m-K or less, when the average fiber diameter is about 23 microns. The data for Examples 1-29 show that with this invention, lambda values well below 50 mW/m-K are obtained at batt densities as low as 7.9 kg/m$^3$.

Comparative Samples E-G show how lambda*density values increase as the density increases. In these samples, higher densities are needed to obtain a desirable lambda value, resulting in a higher raw material cost for these materials.

EXAMPLES 30-42

Batt Examples 30-42 are made using the lab scale process described with respect to batt Examples 11-13. The fiber blend in each case is set forth in Table 2 below. Layer thickness for these samples ranges from 0.82 to 1 mm. Batt thicknesses range from 160 to 200 mm. The number of plies varies somewhat according to thickness and average layer thickness.

Lambda, density and lambda*density are determined as described with respect to Examples 1-5, with results being as indicated in Table 3 below.

EXAMPLES 43-45

Batt Examples 43-45 is made using the general large scale process described with respect to batt Examples 6-7. In each case the fiber blend is 30 weight percent of a 2 denier bicomponent as in Examples 1-5, 40 weight percent of a 1.5 denier solid polyethylene terephthalate staple fiber and 30 weight percent of a solid 3.0 denier polyethylene terephthalate staple fiber. Average fiber diameter is 14.0 mm. To produce batt Example 43, two 100-mm thick batts are made using 56 layers of the web material. The individual layer thickness for batt Example 43 is 1.78 mm. To produce batt Example 44, two 100-mm thick batts are made using 60 layers of the web material. The individual layer thickness for batt Example 44 is 1.67 mm. To produce batt Example 45, two 100-mm thick batts are made using about 63 layers of the web material. The individual layer thickness for batt Example 45 is 1.48 mm.

Lambda, density and lambda*density are determined as described with respect to Examples 1-5, with results being as indicated in Table 3 below.

EXAMPLE 46

Batt Example 46 is made in the same manner as batt Example 43, to a slightly lower density. Fiber composition is the same as for Example 32 (see Table 2 below).

Lambda, density and lambda*density are determined as described with respect to Examples 1-5, with results being as indicated in Table 3 below.

TABLE 2

| Example No. | Wt. ratio of fibers | First fiber* | Second Fiber* | Third Fiber* |
|---|---|---|---|---|
| 30 | 40/30/30 | 2 denier bicomponent as in Ex. 1-5 | 1.5 denier solid staple, sawtooth crimped | 3.0 denier hollow staple |
| 31 | 40/30/30 | As in Ex. 30, black | As in Ex. 30, black | 3.0 denier solid staple, black |
| 32 | 30/50/20 | As in Ex. 31 | As in Ex. 30 | As in Ex. 31 |
| 33 | 30/50/20 | As in Ex. 31 | As in Ex. 30 | 3.0 denier staple, spiral crimped |
| 34 | 40/30/30 | As in Ex. 30 | As in Ex. 30 | 2.0 denier solid spiral |
| 35 | 40/40/20 | 6.3 denier sheath core bicomponent | As in Ex. 30 | 3.0 denier, hollow, spiral crimped |
| 36 | 30/30/40 | As in Ex. 30 | As in Ex. 30 | 6.0 denier spiral |
| 37 | 30/30/40 | As in Ex. 30 | As in Ex. 30 | 6.0 denier trilobal solid staple |
| 38 | 30/30/40 | 50/50 blend of bicomponent as in Ex. 30 and a 6 denier sheath/core bicomponent | As in Ex. 30 | As in Ex. 30 |
| 39 | 30/45/25 | As in Ex. 30 | As in Ex 30 | 4.5 denier siliconized hollow spiral |
| 40 | 30/50/20 | 6 denier sheath/core bicomponent | As in Ex 30 | As in Ex. 31, with blue colorant |
| 41 | 40/60 | As in Ex. 1-5. | 2.0 denier Pre-oxidized acrylic | None |
| 42 | 40/20/40 | As in Ex. 30 | 3.0 denier solid, sawtooth crimped | 2.0 denier hollow spiral |

*Fibers in this table are polyethylene terephthalate unless otherwise noted

TABLE 3

| Ex. No. | Wt-ave. Fiber Diameter (μm) | Bico/Staple Weight Ratio | Batt Thickness, mm | Batt density, kg/m$^3$ | Lambda, mW/m-K | Lambda* density |
|---|---|---|---|---|---|---|
| 30 | 14.3 | 40/60 | 190 | 10.9 | 39.5 | 431 |
| 31 | 14.3 | 40/60 | 200 | 10.9 | 37.3 | 407 |
| 32 | 13.6 | 30/70 | 200 | 11.2 | 37.5 | 420 |
| 33 | 13.6 | 30/70 | 190 | 10.6 | 37.9 | 404 |
| 34 | 13.7 | 40/60 | 190 | 10.9 | 37.5 | 409 |
| 35 | 15.4 | 40/60 | 190 | 11.9 | 37.9 | 475 |
| 36 | 15.8 | 30/70 | 190 | 10.2 | 42.2 | 430 |
| 37 | 15.1 | 30/70 | 190 | 10.6 | 40.7 | 431 |
| 38 | 14.5 | 30/70 | 180 | 10.8 | 40.0 | 432 |
| 39 | 14.0 | 30/70 | 190 | 10.3 | 38.9 | 401 |
| 40 | 14.6 | 30/70 | 160 | 12.2 | 38.3 | 467 |
| 41 | 14.4 | 40/60 | 90 | 11.5 | 36.7 | 422 |
| 42 | 14.8 | 40/60 | 200 | 11.2 | 39.4 | 441 |
| 43 | 14.0 | 30/70 | 200 | 10.1 | 41.5 | 419 |
| 44 | 14.0 | 30/70 | 200 | 11.3 | 39.8 | 448 |
| 45 | 14.0 | 30/70 | 200 | 12.3 | 39.6 | 487 |
| 46 | 13.6 | 30/70 | 200 | 10.0 | 40.8 | 408 |

The results in Table 3 show that with the invention, good lambda and lambda*density values can be obtained using various combinations of fiber types. In particular, the presence of some quantity of larger diameter fibers still leads to good results as long as the average fiber diameter is within the range of 9.0 to 20.5 microns.

Comparative Samples H and I

Comparative Sample H is made in the same general manner as Example 1, except a 50/50 by weight ratio of the bicomponent and staple fibers is used. Average fiber diameter is 15.7 microns. Batt density is 10.7 kg/m$^3$. Individual layer thickness in the calibrated and heat-set batt is about 0.85 mm.

Comparative Sample I is made in the same general manner as Example 1, except a 10/90 by weight ratio of the bicomponent and staple fibers is used. Average fiber diameter is 17.1 microns. Batt density is 10.2 kg/m$^3$. Individual layer thickness in the calibrated and heat-set batt is about 0.98 mm.

PHYSICAL PROPERTY EVALUATIONS OF EXAMPLES 5, 6, 8, 29, 43, 44 AND 46

Various additional properties are measured for Batt Examples 5, 6, 8, 29, 43, 44 and 46, as well as for Comparative Samples H and I. Results are as reported in Table 4.

Bending deflection is measured according to the test described before, with the deflection in millimeters being reported in both directions.

Recovery from compression is determined by cutting a 150 mm×150 mm specimen, and measuring the initial thickness of the specimen. The batt is then compressed to 25% of its original thickness for 11 days. Conditions during the period of compression are about 20-25° C. and ambient relative humidity. The thickness of the sample is then measured 30 minutes after compressive forces are removed from the sample. % recovery is calculated as:

[1−(initial thickness−final thickness)]*100/initial thickness.

A second measurement is made after 24 hours.

Tensile stress and elongation are measured according to EN 12311-1-1999 on a 50 mm×30 mm sample.

TABLE 4

| Ex. No. | Layer thickness, mm | Density (kg/m$^3$) | Bending Deflection, mm | Recovery from Compression, % at 30 min/ 24 hr. | Tensile Stress (in kPa) and Elongation (%) in Machine/Cross Direction | |
|---|---|---|---|---|---|---|
| 5 | 0.99 | 10.1 | 145/90 | 88/94 | 30.9/30.9 | 6.0/48 |
| 6 | 2.5 | 11.2 | 50/40 | 81/89 | 104/33 | 34.6/32.8 |
| 8 | 1.05 | 9.6 | 40/35 | 92/99 | 32.5/32.1 | 4.3/76.8 |
| 29 | 0.92 | 11.0 | No Data | 88/92 | 40.8/29.8 | 6.7/85 |
| 43 | 1.78 | 10.1 | 165/115 | 76/83 | 50.6/31 | 12/45.4 |
| 44 | 1.67 | 11.3 | 115/25 | 77/83 | 106.8/30 | 12/41.7 |
| 46 | 1.78 | 10.0 | 230/185 | 72/78 | 51.5/25 | 10/49 |
| Comp. H* | 0.85 | 10.7 | 75/50 | 80/84 | 93.7/31.2 | 17.2/52.6 |
| Comp. I* | 0.98 | 10.2 | No Data | 95/98 | 18.8/25.9 | 1.7/101.4 |

*Not an example of this invention

The data for Comparative Sample H shows the effect of having a high level of bicomponent fibers. Recovery from compression falls significantly compared to batt Examples 5, 8 and 20, which have comparable individual layer thicknesses. The data for Comparative Sample I shows the effect of having a very low level of bicomponent fibers. Tensile properties drop precipitously, and become so low that the batt is difficult to use.

Examples 6, 43, 44 and 46 illustrate the influence of individual layer thickness on the ability of the batt to recover from compression. These batts recover less of their original thickness than do the batts made having thinner individual layers.

EXAMPLE 47

A batt is made by a pneumatic carding (air-lay) process as follows. Fibers are received in large bales, weighed and mixed at the desired proportions as described in preceding examples. The fiber composition is 30% of a 2 denier bicomponent core/sheath polyethylene terephthalate/polyethylene terephthalate fiber, 30% of a 3 denier crimped staple polyethylene terephthalate fiber and 40% of a 1.5 denier crimped staple polyethylene terephthalate fiber. The fiber blend has an average fiber diameter of 14 microns.

The blended fibers are dropped onto a conveyor which transports the fiber to an air-lay machine from a pneumatic carding device which grabs and fluffs the fibers. The carded fibers are then fed into an air stream and collected on a moving belt where they form a web of randomly distributed fibers of 120 mm thickness and 8 kg/m$^3$ density. Two of these web layers are stacked and compressed and heat set as described in the preceding examples to form a batt with a density of 10.1 kg/m$^3$ and a thickness of 190 mm. The thermal conductivity of the resulting batt is 43.5 mW/m-K. The value of lambda*density is 434. Tensile stress and elongation are measured according to EN 12311-1-1999 on a 50 mm×300 mm×40 mm sample. Tensile stress is 3 kPa at 58% elongation and 8 kPa at 27% elongation, respectively, for the machine and cross direction.

EXAMPLE 48

A batt is made by a pneumatic carding (air-lay) process as follows. Fibers are received in large bales, weighed and mixed at the desired proportions as described in preceding examples. The fiber composition is 20% of a 4 denier bicomponent core/sheath polyethylene terephthalate/polyethylene terephthalate fiber, 70% of a 0.7 denier crimped staple polyethylene terephthalate fiber and 10% of a 15 denier crimped staple polyethylene terephthalate fiber. The fiber blend has an average fiber diameter of 9.3 microns.

The blended fibers are dropped onto a conveyor which transports the fiber to an air-lay machine from a pneumatic carding device which grabs and fluffs the fibers. The fibers are then fed into an air stream and collected on a moving belt where they form a web of randomly distributed fibers of 100 mm thickness and 12.5 kg/m$^3$ density. The thermal conductivity of the batt is 36.5 mW/m-K. The value of lambda*density is 456. Tensile stress and elongation are measured according to EN 12311-1-1999 on a 100 mm×300 mm×40 mm sample. Tensile stress is 5 kPa at 51% elongation and 13 kPa at 45% elongation, respectively, for the machine and cross direction.

What is claimed is:

1. A compressible polyester fiber thermal insulation batt formed of entangled and melt-bonded polyester fibers, the polyester fibers including from 55-85% by weight of at least one staple fiber and from 15-45% by weight of at least one binder fiber, wherein the average fiber diameter is from 7.0 to 20.5 microns and at least 55% by weight of the fibers are crimped, wherein the insulation batt A) has an uncompressed bulk density of from 5 to 15 kg/m$^3$, B) exhibits a lambda value of from 30 to 50 mW/m-K, C) exhibits a lambda*density value of from 250-550 when lambda is expressed in units of mW/m-K and density is expressed in units of kg/m$^3$, D) has an uncompressed thickness of from 25-300 mm and E) exhibits a tensile stress at break of at least 4 KPa in at least one of the machine and cross-machine directions.

2. The insulation batt of claim 1 where in the average fiber diameter is from 9.0 to 20.5 microns.

3. The thermal insulation batt of claim 1 wherein the polyester fibers include from 55-80% by weight of at least one staple fiber and from 20 to 45% by weight of at least one binder fiber, wherein the average fiber diameter is from 12.0 to 20.5 microns and wherein the uncompressed bulk density is from 6 to 14 kg/m$^3$ and the lambda value is from 35-50 mW/m-K.

4. The insulation batt of claim 1 wherein said binder fiber is a multicomponent fiber.

5. The insulation batt of claim 4 wherein said staple fiber is a polyethyelene terephthalate fiber.

6. The insulation batt of claim 1 which recovers at least 70% of its initial thickness within 30 minutes after being compressed to 25% of its original thickness for a period of 11 days.

7. The insulation batt of claim 6 which recovers at least 85% of its initial thickness within 30 minutes after being compressed to 25% of its original thickness for a period of 11 days.

8. The insulation batt of claim 6 wherein the multicomponent fiber includes at least one surface portion of a lower-softening polyester resin, and at least one other portion of a higher-softening polyester resin.

9. The insulation batt of claim 1 wherein at least some of the fibers contain an IR absorbing agent.

10. The insulation batt of claim 9 wherein the IR absorbing agent is titanium dioxide, a carbonaceous material or calcium carbonate.

11. A polyester fiber thermal insulation batt in the form of a boardstock having an uncompressed thickness of from 25 to 300 mm, the batt exhibiting an overhang deflection value of 240 mm or less, wherein the batt is formed of entangled and melt-bonded polyester fibers, the polyester fibers including from 55-85% by weight of at least one staple fiber and from 15-45% by weight of at least one binder fiber, wherein the average fiber diameter is from 7.0 to 20.5 microns and at least 55% by weight of the fibers are crimped, and the insulation batt A) has an uncompressed bulk density of from 6 to 14 kg/m$^3$ and B) exhibits a lambda value of from 30 to 50 mW/m-K.

12. A rolled polyester fiber thermal insulation batt, the batt having an uncompressed thickness of from 25 to 300 mm, and an uncompressed bulk density of from 6 to 14 kg/m$^3$, said batt being compressed in the roll to 25% or less of its uncompressed thickness, wherein the polyester batt is formed of entangled and melt-bonded polyester fibers, the polyester fibers including from 55-80% by weight of at least one staple fiber and from 15-45% by weight of at least one binder fiber, wherein the average fiber diameter is from 7.0 to 20.5 microns and at least 55% by weight of the fibers are crimped, and further wherein the insulation batt upon unrolling and re-expansion exhibits a lambda value of from 30 to 50 mW/m-K, exhibits a lambda*density value of from 250 to 550 when lambda is expressed in units of mW/m-K and density is expressed in units of kg/m$^3$ and has an uncompressed thickness of from 25-300 mm.

13. A wall, ceiling, roof or floor construction comprising at least one major surface joined to a frame structure that includes at least two generally parallel frame members, the frame members and said at least one major surface defining at least one cavity, wherein the cavity is substantially filled with a polyester fiber thermal insulation batt of claim 1.

14. A method for insulating a wall, ceiling, roof or floor construction having one or more cavities defined by at least one major surfaces that is joined to a frame structure that includes at least two generally parallel frame members, comprising inserting into at least one such cavity a polyester fiber thermal insulation batt of claim 1.

15. A wall, ceiling, roof or floor construction comprising at least one major surface joined to a frame structure that includes at least two generally parallel frame members, the frame members and said at least one major surface defining at least one cavity, wherein the cavity is substantially filled with a polyester fiber thermal insulation batt of claim 11.

16. A method for insulating a wall, ceiling, roof or floor construction having one or more cavities defined by at least one major surfaces that is joined to a frame structure that includes at least two generally parallel frame members, comprising inserting into at least one such cavity a polyester fiber thermal insulation batt of claim 11.

17. A wall, ceiling, roof or floor construction comprising at least one major surface joined to a frame structure that includes at least two generally parallel frame members, the frame members and said at least one major surface defining at least one cavity, wherein the cavity is substantially filled with a polyester fiber thermal insulation batt of claim 12.

18. A method for insulating a wall, ceiling, roof or floor construction having one or more cavities defined by at least one major surfaces that is joined to a frame structure that includes at least two generally parallel frame members, comprising inserting into at least one such cavity a polyester fiber thermal insulation batt of claim 12.

* * * * *